US006185759B1

(12) United States Patent
Staudenmayer

(10) Patent No.: US 6,185,759 B1
(45) Date of Patent: Feb. 13, 2001

(54) BUILT-IN SANITARY FURNITURE UNIT

(76) Inventor: Winfried Staudenmayer, Bruhlstrasse 40, D-73084 Salach (DE)

( * ) Notice: Under 35 U.S.C. 154(b), the term of this patent shall be extended for 0 days.

(21) Appl. No.: 09/380,629

(22) PCT Filed: Mar. 14, 1998

(86) PCT No.: PCT/EP98/01492

§ 371 Date: Sep. 20, 1999

§ 102(e) Date: Sep. 20, 1999

(87) PCT Pub. No.: WO98/41135

PCT Pub. Date: Sep. 24, 1998

(30) Foreign Application Priority Data

Mar. 18, 1997 (DE) ..... 197 11 308
Feb. 9, 1998 (DE) ..... 198 05 039

(51) Int. Cl.[7] ..... A47K 4/00; E03C 1/01

(52) U.S. Cl. ..... 4/663; 4/254; 4/604; 4/608; 4/610; 4/611; 4/664

(58) Field of Search ..... 4/663, 664, 665, 4/604, 254, 560.1, 561.1, 237, 608, 610, 611, 612, 614

(56) References Cited

U.S. PATENT DOCUMENTS

| | | | | |
|---|---|---|---|---|
| 2,650,368 | | 9/1953 | Evans . | |
| 2,907,048 | | 10/1959 | Gould . | |
| 3,616,467 | * | 11/1971 | Drain | 4/604 |
| 4,045,827 | * | 9/1977 | Morris et al. | 4/664 |
| 4,112,524 | | 9/1978 | Johansson | 4/664 |
| 4,266,305 | * | 5/1981 | Kavaloski et al. | 4/254 X |
| 4,628,550 | | 12/1986 | Walton . | |
| 4,680,817 | | 7/1987 | Sloan et al. | 4/663 |
| 4,718,131 | | 1/1988 | Kitamura et al. | 4/663 |
| 4,998,305 | | 3/1991 | Davis . | |
| 5,426,900 | | 6/1995 | Springer . | |
| 5,477,574 | * | 12/1995 | Skoe | 4/560.1 |
| 5,687,431 | * | 11/1997 | Garrett | 4/254 |
| 5,926,859 | * | 7/1999 | Kimura | 4/254 |

FOREIGN PATENT DOCUMENTS

| | | | |
|---|---|---|---|
| 1360 40 | 8/1982 | (DE) . | |
| 3224378A1 | 1/1984 | (DE) . | |
| 2612163C2 | 5/1985 | (DE) . | |
| 3831614A1 | 5/1989 | (DE) . | |
| 4029234A1 | 3/1992 | (DE) . | |
| 4131683A1 | 4/1993 | (DE) . | |
| 9310371 | 11/1993 | (DE) . | |
| 833316 | 10/1938 | (FR) | 4/663 |
| 845280 | 8/1939 | (FR) . | |
| 1389550 | 1/1965 | (FR) . | |
| 2 616 821 | 12/1988 | (FR) . | |
| 2 701 829 | 9/1994 | (FR) | 4/604 |
| 2 719 330 | 11/1995 | (FR) . | |
| 1 521 681 | 8/1978 | (GB) | 4/663 |
| 2266735 | 11/1993 | (GB) . | |
| WO 90/10414 | 9/1990 | (WO) . | |

* cited by examiner

*Primary Examiner*—Henry J. Recla
*Assistant Examiner*—Kathleen J. Prunner
(74) *Attorney, Agent, or Firm*—Jones, Tullar & Cooper, P.C.

(57) ABSTRACT

A built-in furniture unit is provided with a fixedly mounted toilet, a shower, a shower tray, a rear wall rigidly connected to the shower tray, and a toilet seat movably mounted on the rear wall. The built-in furniture unit is designed as a cubicle. The essential advantage of this built-in furniture unit is that it can be installed, for example, in the bedroom of a person in need of nursing, so transforming the bedroom into a nursing care room.

25 Claims, 9 Drawing Sheets

BUILT-IN SANITARY FURNITURE UNIT

FIELD OF THE INVENTION

The present invention relates to a built-in sanitary furniture unit having a shower, a shower tray, a rear wall tightly joined to the shower tray, a toilet inside the built-in furniture unit, and a seat embodied as a toilet seat, with a mount for the toilet seat provided on the rear wall.

BACKGROUND OF THE INVENTION

Particularly for renovating hotel rooms, shower cubicles are known that have a shower tray and are designed as a cubicle that is open on one side. A shower rod for holding the shower head is located on the wall of the cubicle, for instance, along with the shower fittings and optionally a soap holder. Cubicles of this design are built into the hotel room and connected to the existing water inlets and outlets. These shower cubicles make it simple to retrofit antiquated hotel rooms by adding a shower. ortable free-standing toilet cubicles, used especially on construction sites, are also known.

Especially in caring at home for persons who cannot care for themselves, it is often inconvenient to wash and care for them in a bathroom that does not meet the needs of the patient. Conventional bathrooms and toilets are unsuitable for such patients and even perhaps for persons with slight handicaps. It is true that these bathrooms can be adapted or reconstructed to suit the needs of these persons, but this is very expensive and sometimes, as in rented apartments, is not allowed. With increasing age or with handicaps from illness come physical limitations that make it impossible for a person to use the toilet, bathtub or shower without help from others. As nursing home accommodations for such patients become increasingly expensive, it is becoming more and more common for them to be cared for at home. Daily care for such a patient demands enormous effort on the part of the caregiver, however, since as a rule the patient must be transported into the tub or toilet, and afterward back into bed. In general, wheelchairs cannot be used in conventional bathrooms.

U.S. Pat. No. 4,680,817 describes a built-in sanitary furniture unit with a door, which tightly closes off the built-in furniture unit so that the built-in furniture unit can be used as a bathtub. The built-in furniture unit includes a bench seat, under which is a toilet bowl that can be moved out of the built-in furniture unit and, after a seat has been lowered, can be used as a toilet outside the built-in furniture unit. For washing up afterward, the user has to enter the built-in furniture unit, or be helped into it by a helper.

SUMMARY OF THE INVENTION

It is therefore an object of the present invention to furnish a built-in sanitary furniture unit with which persons requiring such care can be cared for substantially more easily, and which is relatively inexpensive.

This object is attained according to the present invention by a built-in sanitary furniture unit of the type described at the outset, in which the toilet seat is secured such that it can be pulled out and retracted, displaced, or swiveled on the mount, at least as far as the edge of the shower tray, with the user seated on it.

The built-in sanitary furniture unit of the present invention is a complete unit and includes both the toilet and the shower and can be constructed independently of the bathroom, for instance in the bedroom, next to the patient's bed. To that end, the built-in sanitary furniture unit of the invention has connection means, in particular on the rear wall, for the cold and optionally hot water inlets and for the wastewater outlet, especially from the toilet and the shower tray. Once the built-in furniture unit has been set up and the water inlets and outlets have been connected, the unit is ready for use, and so the patient can be cared for in his bedroom, not far from his bed. There is no longer any need to transport the patient to the bathroom or toilet; on the one hand this lessens the risk of accidents, and on the other it offers the patient the chance to perform toilet activities on his own, without help from others. The bathroom, which no longer needs to be reconstructed, can continue to be used by the other members of the family. In particular, the toilet or shower of the built-in unit can be used regardless of whether or not the bathroom itself is available, so there is no need for the patient to wait.

Further advantages of the present invention will become apparent from the specification and claims. The built-in sanitary furniture unit is accordingly an open, prefabricated unit on the order of a half-shell, in a corner version that takes up only one square meter of floor space. To make optimal use of the space in the built-in sanitary furniture unit and to provide optimal care, the toilet and shower are disposed one above the other. Thus the toilet seat simultaneously serves as a shower seat and is secured directly about the toilet bowl. The toilet seat has the usual opening, so that it can be used for using the toilet as well and does not have to be raised.

A major advantage is considered to be that the toilet seat can be moved or swiveled on its mount far enough out of the cubicle that the user can easily take a seat on the toilet seat and can slide or swivel effortlessly into the cubicle. The toilet seat has locks for its terminal positions. The toilet seat is also provided with swinging grab bars, so that particularly when the patient stands up from a wheelchair and sits down on the toilet seat, the grab bars provide sure support and guidance.

One advantageous embodiment provides that the built-in sanitary furniture unit is equipped with two swivelable curtain rods, which to close the cubicle are swiveled in front of it and can be swiveled back again on entering or leaving the cubicle. In addition, with the curtains swiveled in front, the privacy of the patient is preserved. The curtain rod can be secured to an adjustable height on the rear wall, so that even with the curtain swiveled in front of him, the patient still has a clear view into the room or of the caregiver, and the caregiver does not lose visual control of the patient.

The wall-mounted toilet bowl allows optimal cleaning of the shower tray, and the toilet itself is flushed pneumatically using a button on the wall. The built-in sanitary furniture unit is also provided with a hydraulic wastewater system for the toilet water and the shower water, so that the wastewater is automatically carried away by a special pump, and optionally with a chopper downstream of it. The shower handle is also adjustable in height and mounted on the rear wall of the built-in furniture unit, and it can be operated with a fitting mounted at elbow level, laterally beside the person seated on the toilet seat, in the rear or control region on the rear wall.

After the patient uses the built-in sanitary furniture unit, he leaves the cubicle without barriers, using the displaceable or swivelable toilet seat. The height of the toilet seat outside the cubicle is selected to be suitable for wheelchair users as well.

Because a pivot bearing that has a vertical axis is secured to the cubicle, and a wash stand is pivotably supported on the pivot bearing in such a way that it can be used both inside and outside the cubicle, the utility of the built-in sanitary furniture unit is increased still further.

In addition to the shower and the toilet, the built-in sanitary furniture unit of the present invention has a wash stand, which can be used either by a person located inside the built-in furniture unit or by persons located outside it. This has the substantial advantage that the wash stand can be used for minor washing up, such as handwashing and the like or for washing objects, outside the built-in furniture unit. To that end, the wash stand is swiveled out of a position inside the built-in furniture unit to a position outside it. Even a patient in a wheelchair, for instance, can then move up to the wash stand and use it conveniently. Once the wash stand has been swiveled into the built-in furniture unit, it can be used by a person seated on the toilet seat. In the built-in furniture unit of the present invention, not only the shower but also a wash stand is available to the patient, and the wash stand can be used both in and out of the built-in furniture unit.

A refinement provides that the pivot bearing is provided in a vertical column. This column is secured to the outside of the cubicle, in particular in the vicinity of the bottom and on one side edge of the cubicle. The space inside the built-in sanitary furniture unit is accordingly still fully available to the patient once the wash stand has been swiveled outward. Nor is any sealing work for the fastening points of the column needed, because these points are located on the outside of the cubicle.

In a preferred exemplary embodiment, the wash stand has a wastewater line that is flexible in at least one portion. This flexible portion allows the wash stand to be swiveled and to be used either inside or outside the cubicle. However, it is also conceivable for the wastewater pipe to be accommodated in the column and thus in the pivot axis, so that a flexible portion can be dispensed with.

It is preferably provided in one exemplary embodiment that the pivoted position of the wash stand can be locked. This increases safety substantially, because patients sometimes support themselves on the wash stand, which must accordingly be fixed. The wash stand can preferably be locked in infinitely graduated positions. Other embodiments provide that the wash stand has fixed positions, in particular within a grid pattern.

A further variant of the present invention provides that the wash stand has a mount for a mirror and/or a mount for a shower head of the shower. This mirror can also be removed from its mount and used separately. Because the shower head can be secured to the wash stand, it does not require a separate faucet. This makes the installation work substantially simpler. The shower head preferably has valves for the water inlet pipe on the shower handle.

Entering the cubicle is made easier for the patient according to the present invention because the cubicle has a boom that can be swiveled and in particular can be locked. The boom can be swiveled into various angular positions, for instance, and locked there.

To preserve the privacy of the patient using the built-in sanitary furniture unit, the cubicle has curtain rods, which can be pivoted upward about a horizontal shaft. This makes entering the cubicle much easier, and the curtain rods can easily be swiveled downward when in use. When not in use they are swiveled upward, causing the curtain to slide along the curtain rod into a lower position where they are bunched together at the side and allow the patient to exit. In addition, a curtain rod swiveled upward is no hindrance either to entering or exiting the built-in furniture unit, or to using the cubicle that has been swiveled out of the cubicle and is now located beside it instead.

Another advantage of the built-in furniture unit is considered to be that the toilet seat can be pivoted out of the cubicle about the pivot bearing. On this pivot bearing, the toilet seat can be swiveled out of the cubicle and in particular shifted to where it is in front of the wash stand, which is also located outside the cubicle. The person can then take a seat on the toilet seat and can use the wash stand in a seated position, outside the cubicle. The pivot bearing is advantageously provided in the vertical column on which the wash stand is pivotably supported.

A refinement provides that the toilet seat has a pivot bearing with a vertical pivot axis. In this way, a toilet seat that has been swiveled back into the cubicle can be positioned correctly above the toilet. The patient can also rotate himself toward the shower, while sitting on the toilet seat.

Further advantages, characteristics and details of the present invention will become apparent from the ensuing description, in which a particularly preferred exemplary embodiment is described in detail in conjunction with the drawing. The characteristics shown in the drawing and recited in the claims and the description may be essential to the present invention either individually or in arbitrary combination.

DESCRIPTION OF THE PREFERRED EMBODIMENTS

Figure 1:
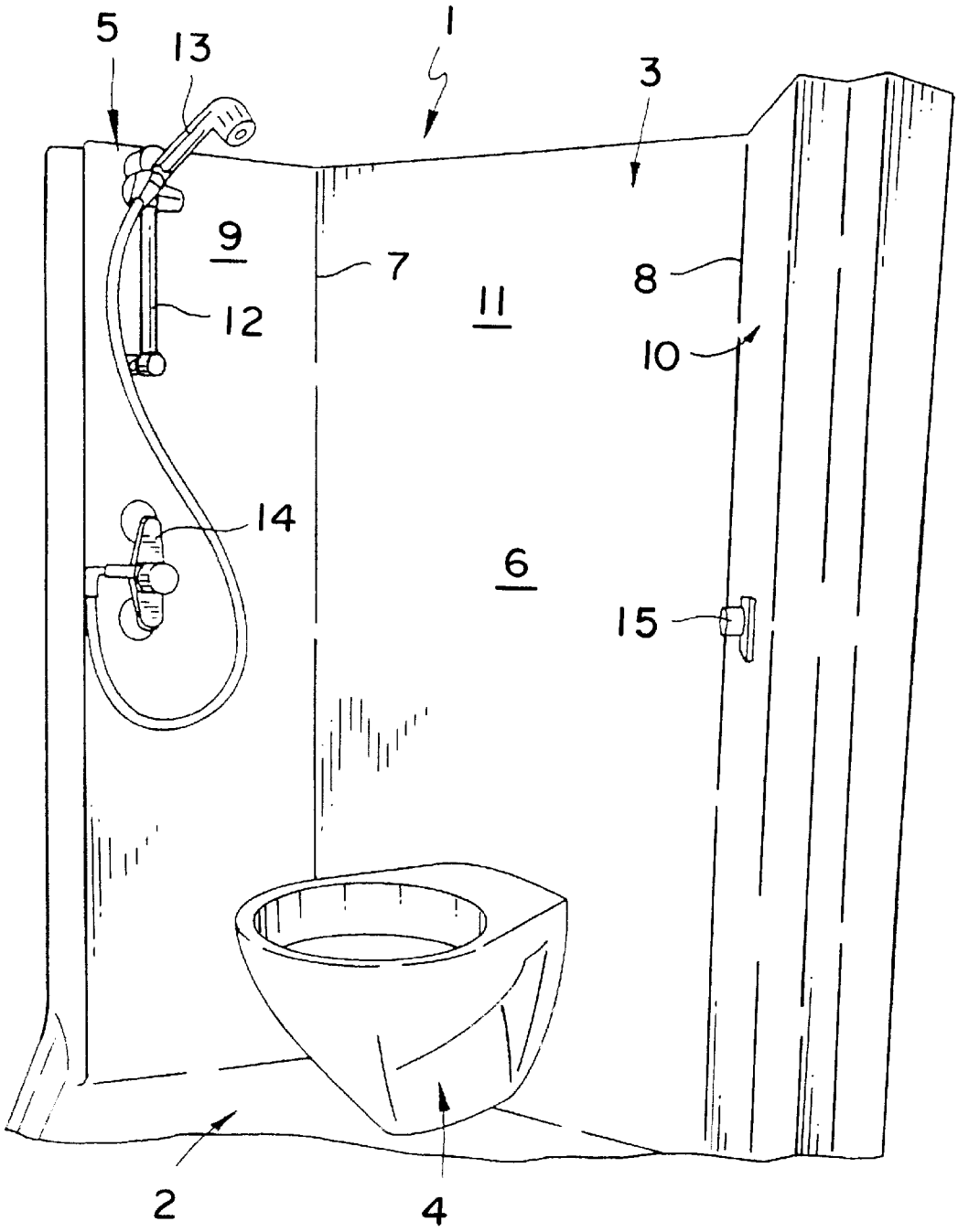
FIG. 1, is a view into the cubicle of the built-in sanitary furniture unit of the present invention, without a toilet seat.
Figure 8:
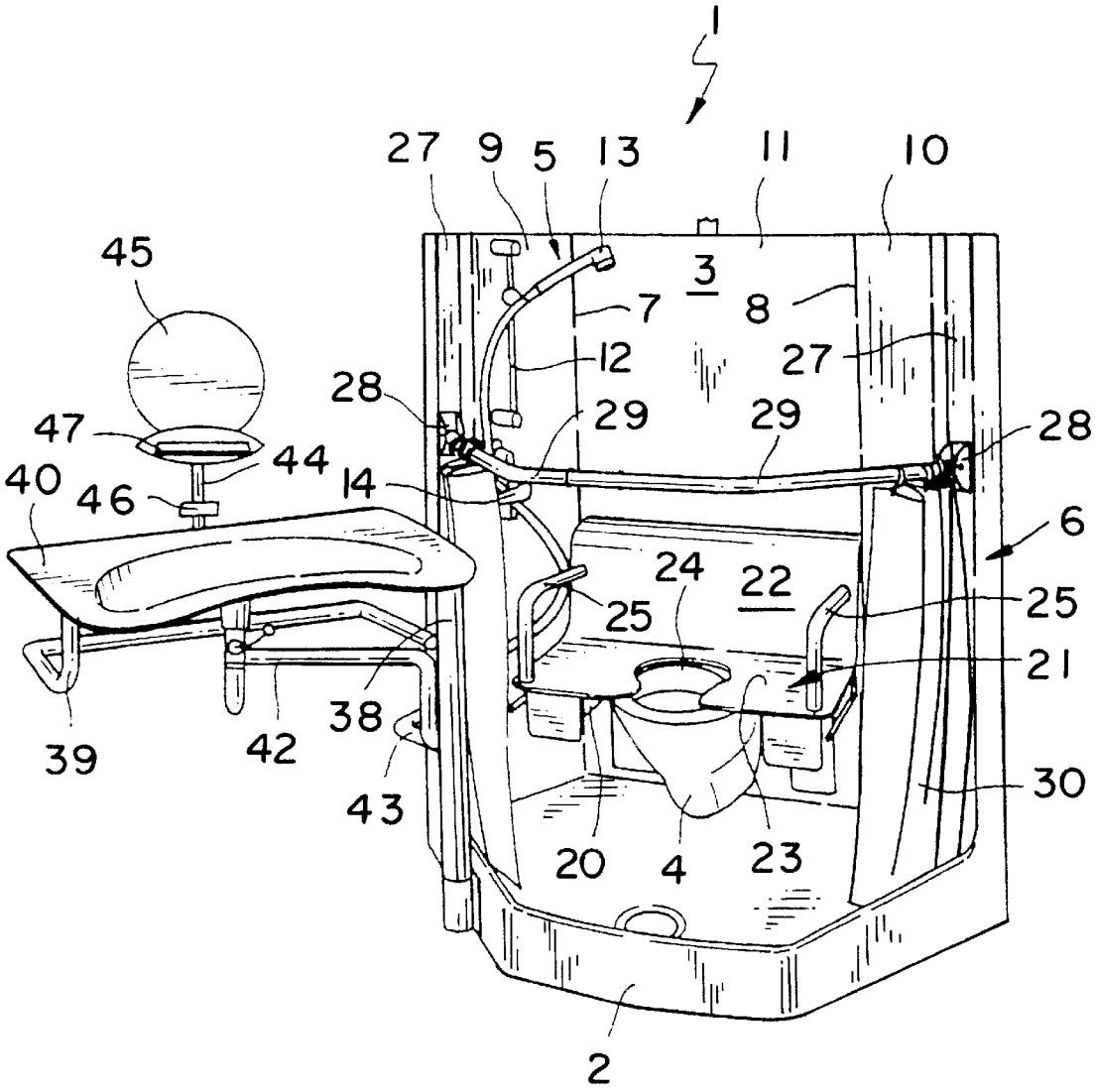
FIG. 8, is a view into the cubicle of the built-in sanitary furniture unit of the present invention with the wash stand swiveled outward.

In FIGS. 1 and 8, a built-in sanitary furniture unit, identified overall by reference numeral 1 is shown, which has a shower tray 2, a rear wall 3, a toilet 4, and a shower 5. Both the shower tray 2 and the rear wall 3 are designed in liquid-type fashion in the form of a cubicle 6 and comprise a glass-fiber-reinforced plastic. The rear wall 3 is angled along two vertical bending lines 7 and 8, creating two side panels 9 and 10, which are oriented orthogonally to one another. The wall-mounted toilet 4 is located on the basic element 11 that is disposed between the two side panels 9 and 10. A shower rod 12 is secured to the side panel 9, and a shower head 13 is mounted on it with adjustable height. The fitting 14 for the shower 5 is also located on the side panel 9 and is mounted at reaching height, that is, the height of an extended elbow. Thus using the shower 5 from the toilet 4 presents no problems. Located on the other side panel 10 is a flush button 15 for the toilet 4, which is also located at the level of an extended elbow.

Figure 2:
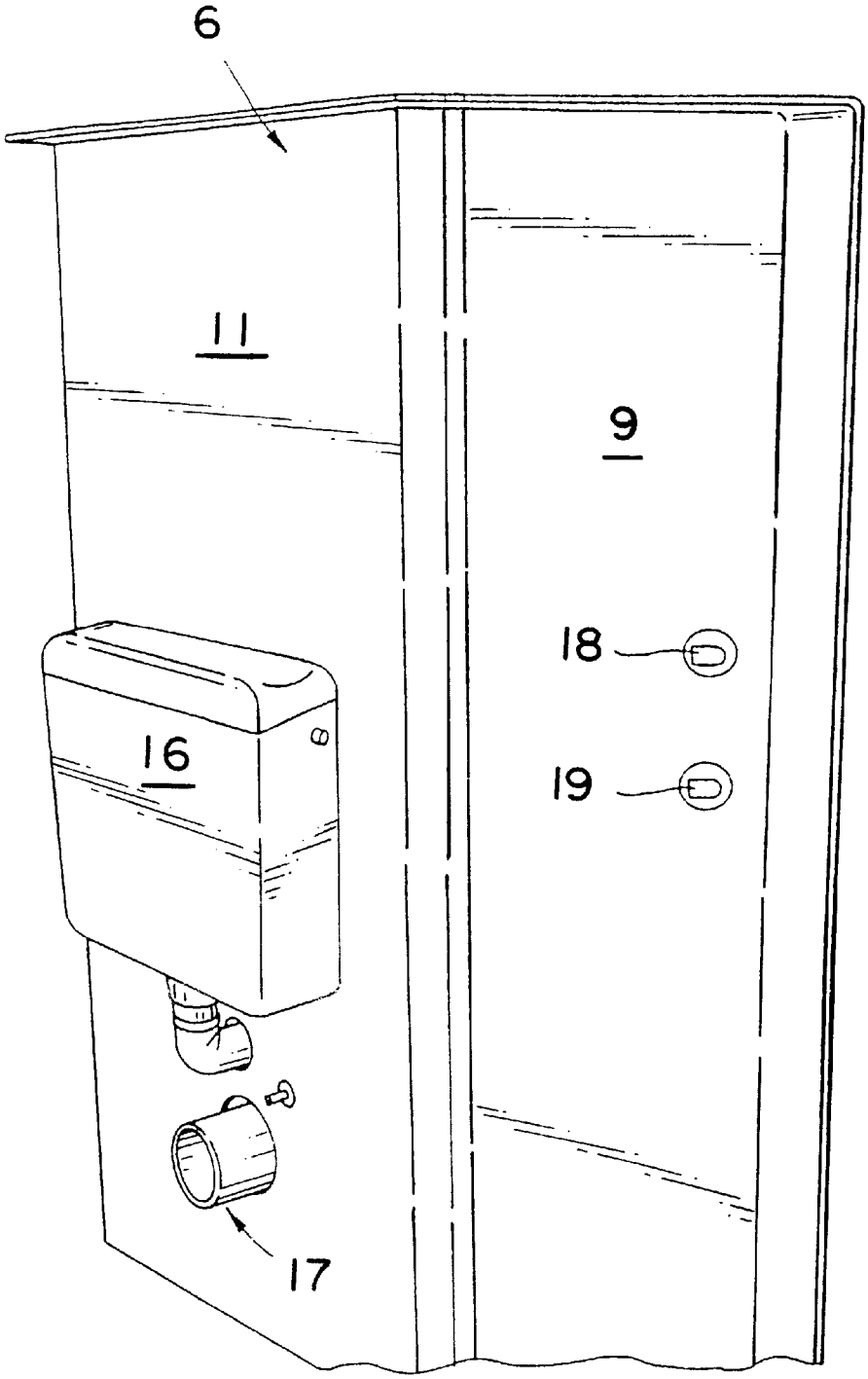
FIG. 2, is a view of the back side of the built-in furniture unit of the present invention.

FIG. 2 shows the backside of the cubicle 6, and a flush tank 16 can be seen on the back side of the basic element of 11. This flush tank 16 can be operated via the flush button 15. Located below the flush tank 16 is a wastewater outlet 17 from the toilet 4. This wastewater outlet 17 is followed by a chopper and a pump (neither of them shown), so that the drain can be connected to a conventional washbasin drain 40 mm in diameter. Also discharging into this drain is the outlet from the shower tray 2 (not shown). Finally, the two connections 18 and 19 of the fitting 14 can also be seen on the side panel 9.

Figure 3:
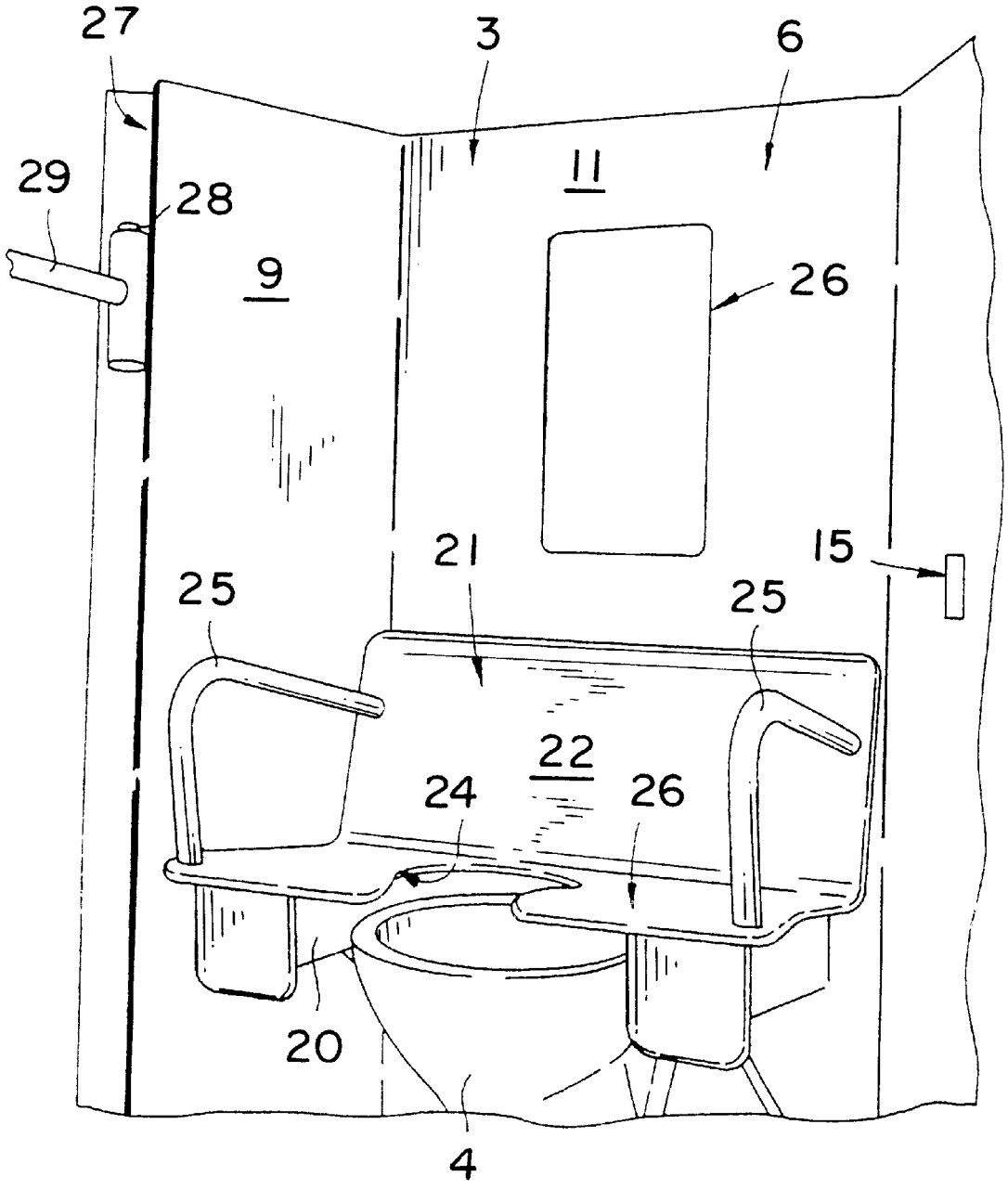
FIG. 3, is a view as in FIG. 1, but with a toilet seat.

In FIGS. 3 and 8, in the region of the upper edge of the toilet 4, there is one mount 20 on each side of the toilet 4 for a toilet seat 21; the mount 20 is rigidly connected to the rear wall 3 or in other words to the basic element 11. The toilet seat 21 is made relatively wide and has both a backrest 22 and a seat surface 23, which has a toilet opening 24 immediately above the toilet 4. Finally, the toilet seat 21, or the seat surface 23, is bounded by grab bars 25.

Above the toilet seat 21 and at the level of the head of a person sitting on it, a headrest 26 is secured to the basic element 11. A bearing 28 for a curtain rod 29 is also provided on the side panel 9, in particular on the free end edge 27. A curtain (not shown) is displaceably supported on this curtain rod 29 and can be pivoted, via the curtain rod 29 that it can be swiveled on the bearing 28, out of the swivel-open position shown in FIG. 3, which allows free access to the cubicle 6, into a closing position by which the cubicle 6 is closed.

Figure 4:
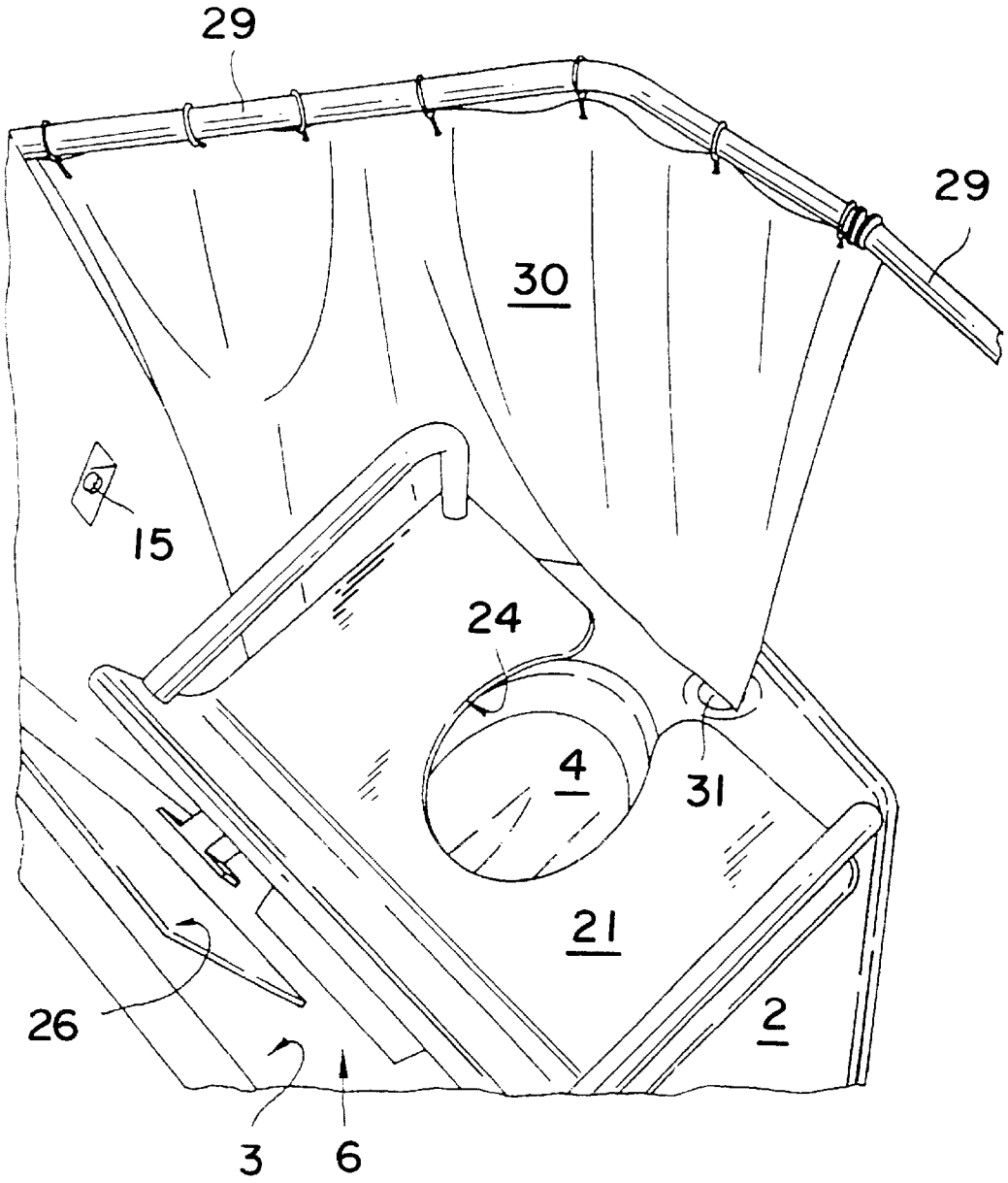
FIG. 4, is a plan view on the toilet seat.
Figure 7:
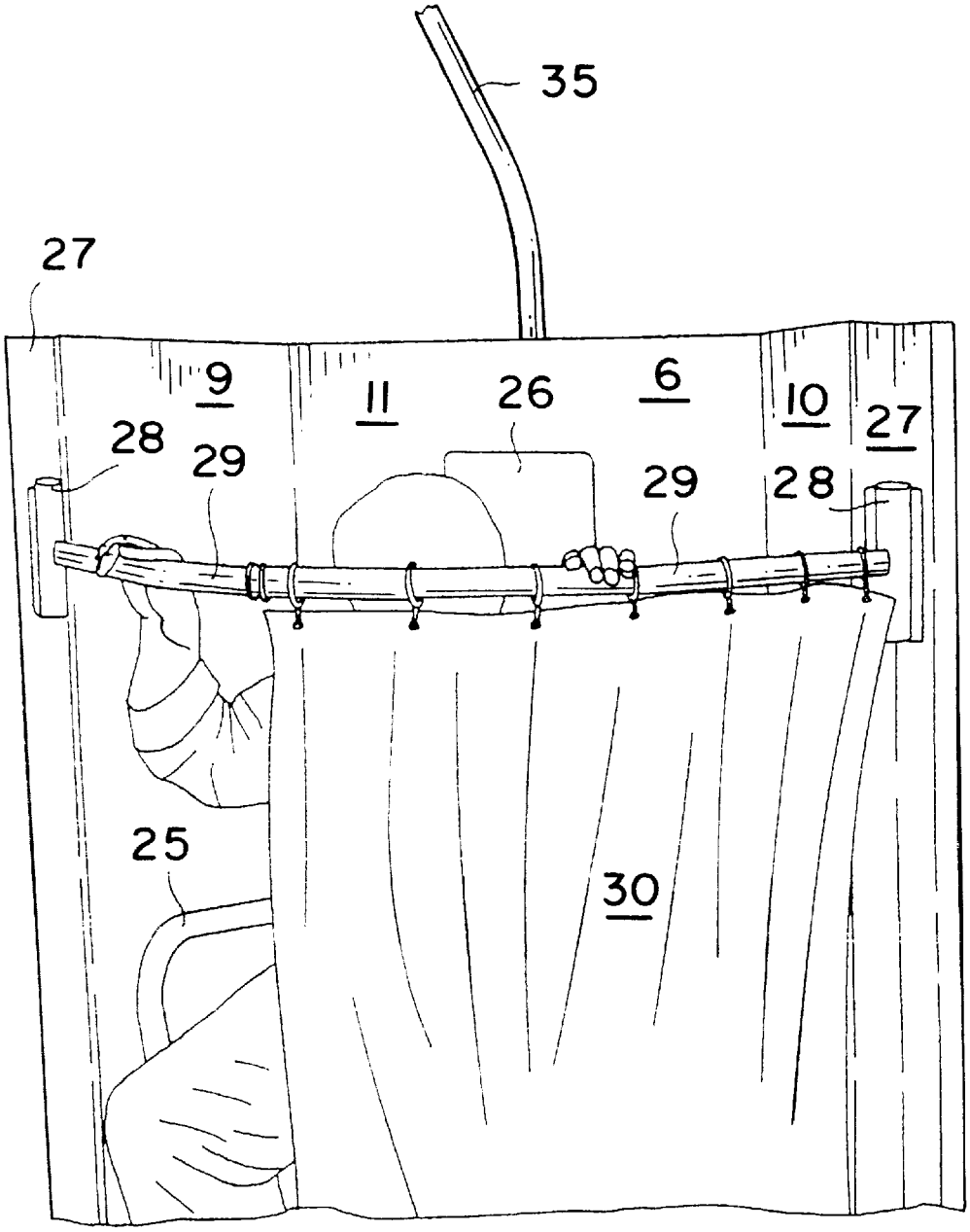
FIG. 7, is a view of the built-in furniture unit with the curtain rods closed.

In FIG. 4, the two curtain rods 29 are shown in their closing position; a curtain 30 is displaceably hung from one curtain rod 29 and pulled forward as far as the free end of the curtain rod 29. This curtain 30 provides optimal splash protection for showering and closes off the cubicle 6 at the front, so that the water can run down both the rear wall 3 and the curtains 30 into the shower tray 2 and from there drain out via the outlet 31. It is also conceivable that only one curtain 30 is used, so that the caregiver then has access to the cubicle 6 and to the patient on the side free of a curtain, as shown in FIG. 7. It can also be seen clearly in FIG. 4 that the toilet opening 24 of the toilet seat 21 is provided directly above the toilet 4.

Figure 5:
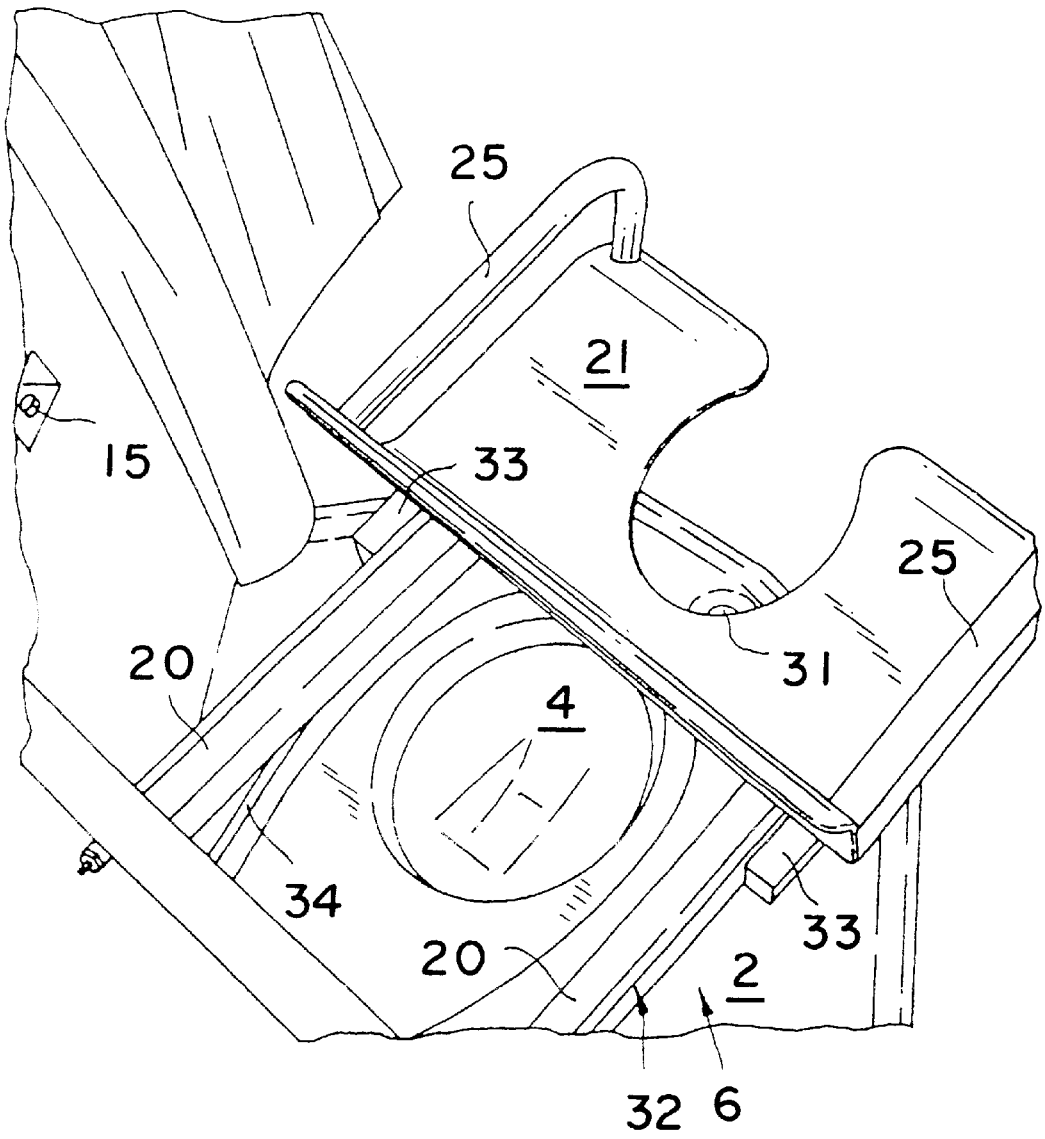
FIG. 5, is a view as in FIG. 4, but with the toilet seat pulled forward.
Figure 6:
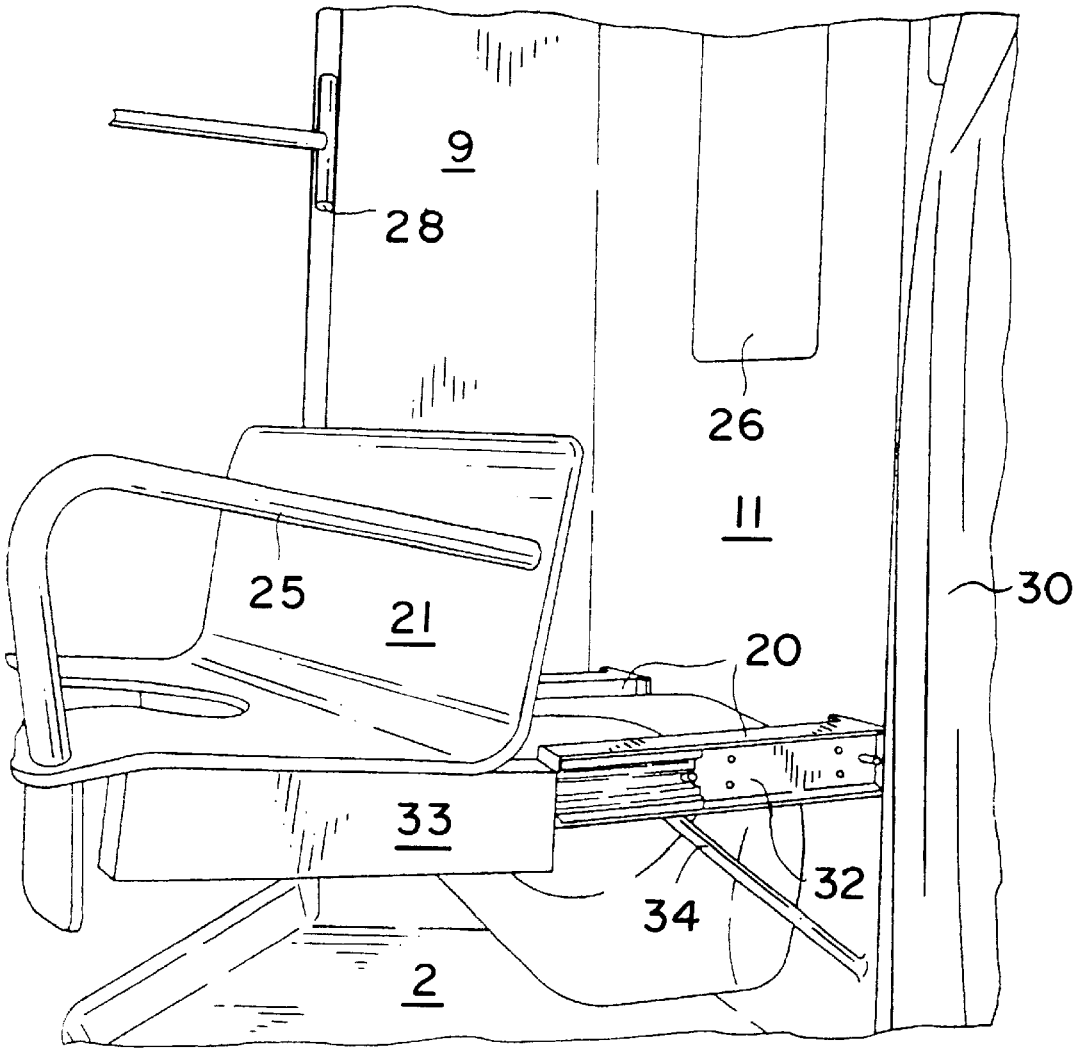
FIG. 6, is a side view of the toilet seat pulled forward.

FIG. 5 shows the cubicle 6 from above, with the toilet seat 21 pulled out. The mount 20, as shown in FIG. 6 as well, has guides 32 for a carriage 33, to which the toilet seat 21 is secured. This carriage 33 can be moved so far along the guide 32 that one can take a seat on the toilet seat 21 without stepping on the shower tray 2. Both the pulled-out terminal position shown in FIGS. 5 and 6 and the retracted terminal position shown in FIG. 4 can be locked via a locking lever, not shown.

In FIGS. 5 and 6, reinforcing struts 34 for the mount 20 can also be seen. These FIGS. also clearly show that the grab bars 25 make it substantially easier to sit down on and get up from the toilet seat 21.

In FIG. 7, a person is shown in the cubicle 6; here only one curtain 30 is provided on one curtain rod 29. Through the uncovered side (in this case shown to the left of the curtain 30), unhindered access to the patient is possible, and the patient can for instance be washed. It can also be seen in FIG. 7 that a boom 35 extends above the basic element 11, and swinging grab bars can be secured to it, by way of which the patient can stand up from the toilet seat or from a wheelchair.

The built-in sanitary furniture unit 1 of the present invention has the substantial advantage that it can be constructed, for instance in the bedroom of a person requiring care, without major reconstruction or installation work, so that the bedroom is easily converted into a hospital-type room. If the built-in sanitary furniture unit 1 is no longer needed, then it can be dismantled again in the quickest possible time, and the hospital room can be converted back into a normal bedroom. The built-in sanitary furniture unit can be embodied as a rental station, so that it can be rented for a freely selectable, limited period of time.

It can also be seen in FIG. 8 that a bearing 28 for a curtain rod 29 is provided on the side panel 9, especially on its free end edge 27. A curtain 30 is supported displaceably on this curtain rod 29 and can be swiveled via the curtain rod 29, which is swiveled on the bearing 28, out of the open position shown in FIG. 9, which allows free access to the cubicle 6, into a closing position, by which the cubicle 6 is closed.

Figure 9:
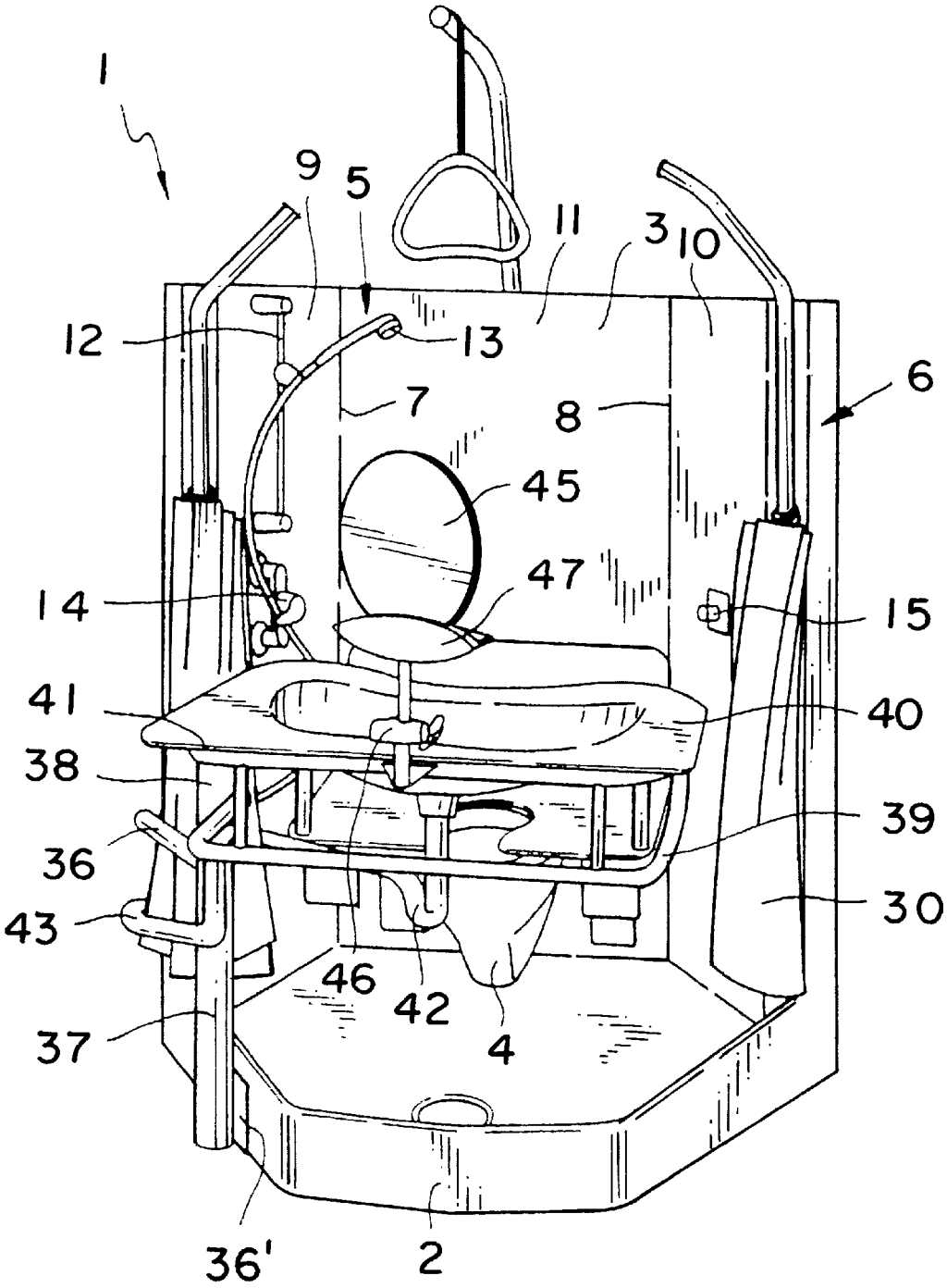
FIG. 9, is a view into the cubicle of the built-in furniture unit of the present invention with the wash stand swiveled inward.

It can also be seen from FIGS. 8 and 9 that a vertical technical column 37 is secured to the cubicle 6, particularly to the outside of the shower tray 2, and beside the left end edge 27, via mounts 36, 36'. This technical column 37 has a pivot bearing 38 on its upper end, and a mounting scaffold 39 for a wash stand 40 is pivotably supported on this pivot bearing. Via this pivot bearing 38, the wash stand 40 can be swiveled out of the position in which it is located inside the cubicle 6, as shown in FIG. 9, into a position in which it is outside the cubicle 6, as shown in FIG. 8. The wash stand 40 advantageously rests with its rear edge 41 on one wall.

The wash stand 40 has a wastewater pipe 42, which has one flexible portion 43. The wash stand 40 is also provided with a mount 44 for a removable mirror 45 and a mount 46 for the shower head 13. A shelf 47, for instance for a comb or a brush, is located below the mirror.

What is claimed is:

1. A built-in sanitary furniture unit, comprising:

a shower;

a shower tray defining an edge;

a rear wall joined tightly to said shower tray;

a toilet inside the built-in furniture unit, including a toilet bowl fixedly mounted in said unit and a toilet seat movably mounted with respect to said bowl; and a mount for said toilet seat connected to said rear wall, wherein said toilet seat is secured to said mount such that it can be displaced according to one of the following: pulled out, retracted, displaced and swivelled on said mount, at least as far as the edge of said shower tray with the user seated thereon.

2. The built-in sanitary furniture unit as defined in claim 1, further comprising the following connections: means for cold water inlet; optionally, means for hot water inlet; means for wastewater outlet; and means for water outlet from said shower tray, wherein all such connections are provided at said rear wall.

3. The built-in sanitary furniture unit as defined in claim 1, wherein said unit is hooked-up in the manner of one of the following: a dishwasher; and a washing machine.

4. The built-in sanitary furniture unit as defined in claim 1, wherein said shower tray and said rear wall form a cubicle open on one side, said shower tray and said cubicle comprising glass-fiber-reinforced plastic.

5. The built-in sanitary furniture unit as defined in claim 1, wherein said shower is installed according to one of on said rear wall; above said toilet seat; and laterally offset from said toilet seat.

6. The built-in sanitary furniture unit as defined in claim 1, further comprising:

a control element for flushing the toilet; and a fitting for the shower, said control element and said fitting are installed on said rear wall all at the level of the user's elbow, in particular the extended elbow, when seated on said toilet seat.

7. The built-in sanitary furniture unit as defined in claim 1, wherein said rear wall defines two vertical bend lines from which angled side panels extend, said angled side panels being aligned substantially orthogonally to one another.

8. The built-in sanitary furniture unit as defined in claim 1, wherein said rear wall is embodied in the shape of a U, in particular in the form of an arc, said rear wall having one of: curved wall elements; straight wall elements; and optionally divergent wall elements.

9. The built-in sanitary furniture unit as defined in claim 1, further comprising:

at least one curtain rod, wherein said rear wall defines free end edges, and wherein said at least one curtain rod is disposed according to one of: on; and in the vicinity of, said free edges.

10. The built-in sanitary furniture unit as defined in claim 9, wherein said at least one curtain rod is swivelable.

11. The built-in sanitary furniture unit as defined in claim 9, further comprising:

a curtain received by said at least one curtain rod in a displaceable fashion.

12. The built-in sanitary furniture unit as defined in claim 9, further comprising:

means defining a horizontal shaft at at least one end of each curtain rod, wherein said curtain rods can be pivoted upward about said horizontal shaft.

13. The built-in sanitary furniture unit as defined in claim 1, further comprising:

a headrest disposed on said rear wall in the vicinity of said toilet seat.

14. The built-in sanitary furniture unit as defined in claim 1, further comprising:

a boom located, in particular, about said toilet seat, and secured to said rear wall, said boom serving for swinging grab bars.

15. The built-in sanitary furniture unit as defined in claim 14, wherein said boom can be swivelled and locked.

16. The built-in sanitary furniture unit as defined in claim 1, wherein said shower tray has a hexagonal contour.

17. The built-in sanitary furniture unit as defined in claim 16, wherein two sides of said shower tray are orthogonal to one another.

18. The built-in sanitary furniture unit as defined in claim 1, where the built-in sanitary furniture unit is embodied as a built-in corner unit.

19. The built-in sanitary furniture unit as defined in claim 1, further comprising:

a pivot bearing defining a vertical axis; and a wash stand pivotably supported on said pivot bearing, wherein said shower tray and said rear wall form a cubicle open on one side, said pivot bearing being secured to said cubicle, and said wash stand being pivotably supported on said pivot bearing in such a way that it can be used both inside and outside said cubicle.

20. The built-in sanitary furniture unit as defined in column 19, wherein said pivot bearing is provided in a vertical column.

21. The built-in sanitary furniture unit as defined in claim 20, wherein said column is secured to the outside of said cubicle, and in particular in the vicinity of the bottom of said cubicle and on one side edge.

22. The built-in sanitary furniture unit as defined in claim 19, further comprising:

a wastewater line for said wash stand, said wastewater line being flexible in at least one portion.

23. The built-in sanitary furniture unit at defined in claim 19, wherein the pivot portion of said wash stand is lockable.

24. The built-in sanitary furniture unit as defined in claim 19, wherein said wash stand includes one of: a mount for a mirror, and a mount for a shower head of said shower.

25. The built-in sanitary furniture unit as defined in claim 1, further comprising:

a pivot bearing about which said toilet seat is pivoted out of a cubicle formed by said shower tray and said rear wall open on one end, said pivot bearing being provided in particular, in a vertical column.

* * * * *